United States Patent [19]

Wilson et al.

[11] Patent Number: 4,783,724

[45] Date of Patent: Nov. 8, 1988

[54] ANGULARLY ADJUSTABLE TASK LIGHT

[75] Inventors: Harold R. Wilson; Paul S. Gartland, both of Holland, Mich.

[73] Assignee: Haworth, Inc., Holland, Mich.

[21] Appl. No.: 22,306

[22] Filed: Mar. 3, 1987

[51] Int. Cl.[4] ..... F21V 21/26; A47B 23/06

[52] U.S. Cl. ..... 362/133; 362/33; 362/269; 362/287; 362/427

[58] Field of Search ..... 362/33, 133, 287, 269, 362/427

[56] References Cited

U.S. PATENT DOCUMENTS

| | | | |
|---|---|---|---|
| 2,594,792 | 4/1952 | Motter | 362/133 |
| 4,254,449 | 3/1981 | Benasutti et al. | 362/133 X |
| 4,413,310 | 11/1983 | Adams | 362/33 X |
| 4,454,569 | 6/1984 | Maguire | 362/33 X |
| 4,471,411 | 9/1984 | Graham et al. | 362/427 X |
| 4,587,602 | 5/1986 | Dean et al. | 362/269 X |

*Primary Examiner*—Michael Koczo
*Assistant Examiner*—Peggy Neils
*Attorney, Agent, or Firm*—Flynn, Thiel, Boutell & Tanis

[57] ABSTRACT

A light fixture mounts on a pair of support bars which are disposed directly below a shelf and extend transversely thereof so that the bar ends are supported on edge channels associated with the shelf. The light fixture has, on the ends of the fixture housing, mounting brackets for engaging the support bars. The mounting brackets are adjustable relative to the housing to vary the angular position of the light fixture.

14 Claims, 4 Drawing Sheets

ANGULARLY ADJUSTABLE TASK LIGHT

FIELD OF THE INVENTION

This invention relates to a light which is mounted below a shelf and, more specifically, to an improved adjustable mounting structure which permits the light to be selectively angularly tilted relative to the shelf.

BACKGROUND OF THE INVENTION

In the office environment, it is conventional to utilize furniture which is known as "system furniture" in that large open areas are divided into smaller working areas by means of a plurality of upright panels which are horizontally serially connected. These panels are designed to permit numerous furniture accessories such as work surfaces, file bins, shelves and the like to be mounted on the panels and project outwardly from the face thereof. In the use of system furniture, it is conventional to mount a shelf or cabinet unit on the panel upwardly above a work surface or desk. To provide adequate lighting for the work surface or desk, it is also conventional to mount a small light fixture (specifically a fluorescent light fixture) directly beneath the shelf or cabinet unit so as to direct light downwardly onto the work surface. Such lighting fixture is commonly known in the industry as a "task" light.

The shelf or cabinet unit normally used for mounting a task light thereunder conventionally has a bottom wall or shelf formed from a shallow downwardly-opening channel member, whereby the bottom wall or shelf hence has front and rear edges which project downwardly and themselves constitute inwardly opening channels. The task light is normally positioned upwardly at least partially into the interior of this bottom channel and, to suspend the task light, the end plates of the light fixture housing are normally provided with downwardly projecting hooks which are integral with the housing end plates, as by being deformed therefrom. These hooks are utilized for permitting the light fixture to be supported on a pair of horizontally elongated support bars, which bars in turn are inserted into the channel member so that the ends thereof are supported within the edge channels.

Task light fixtures mounted in the manner described above have been utilized for many years, and have functioned in a generally satisfactory manner. However, in some situations, such as when the occupant of the office space is sitting outwardly away from the shelf structure at a slightly lower elevation than the light, it has been observed that the light energy emitted through the diffuser of the light fixture is oriented directly toward the occupant's eyes, and hence creates an uncomfortable or undesirable work environment. The current arrangement for mounting the task light fixture, however, does not include any means for permitting adjustment of the light fixture to eliminate this problem.

Accordingly, it is an object of this invention to provide an improved arrangement which permits the task light fixture, as mounted beneath a shelf unit, to be selectively angularly adjusted over at least a narrow range so as to eliminate direct glare into the occupant's eyes.

It is also an object of this invention to provide an improved mounting arrangement for a task light fixture, as aforesaid, which still permits the light fixture to be readily and easily mounted beneath a standard shelf unit, which permits the inclination of the light fixture to be adjusted in a simple and easy manner, and which permits the overall fixture and the mounting thereof to be manufactured, assembled and installed in an efficient and economical manner.

In the improved arrangement of the present invention, the light fixture housing is provided with a mounting structure which permits tilting of the light fixture relative to the support bars. This mounting structure includes a pair of mounting brackets which are mounted on the opposite end walls of the fixture housing, which brackets are pivotally connected to the end walls adjacent one end, and are releasably secured to the end walls at the other end by a manually releasable lock structure. This latter structure includes manually engageable knobs which threadably engage studs projecting from the end walls of the fixture, which studs project through vertically elongated slots formed in the brackets. When the knobs are released, the fixture can be relatively vertically pivoted into the desired orientation, whereupon the knobs are then tightened to lock the fixture to the brackets. The brackets themselves define thereon mounts which receive therein horizontally elongated support bars, the latter being disposed so as to be positioned within the interior of the shelf channel and extend thereacross so that opposite ends thereof are supported within the edge channels.

Other objects and purposes of the invention will be apparent to persons familiar with structures of this general type upon reading the following specification and inspecting the accompanying drawings.

Figure 1:
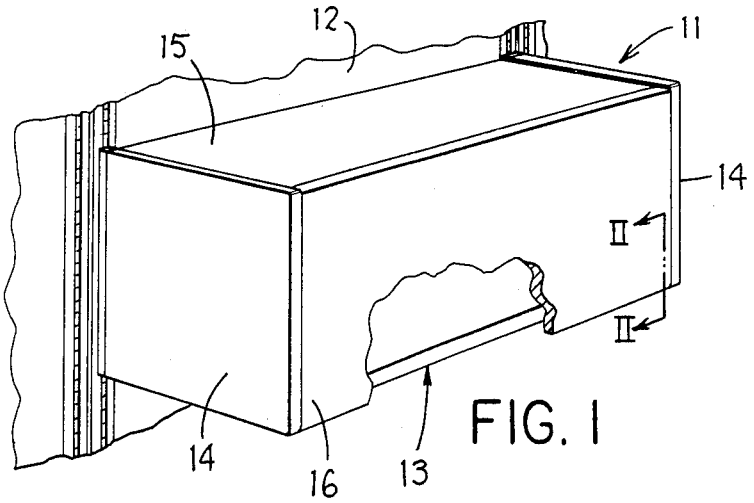
FIG. 1 is a fragmentary perspective view illustrating one type of shelf or cabinet structure which mounts on the front of a vertical wall panel, which structure is adapted to have a task light fixture mounted thereunder.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the structure and designated parts thereof. Said terminology will include the words specifically mentioned, derivatives thereof, and words of similar import.

DETAILED DESCRIPTION

Referring to FIG. 1, there is illustrated a conventional storage shelf or cabinet unit 11 which is adapted to be mounted in a conventional manner on an upright wall panel 12. The shelf unit 11 includes a horizontally extending shelf structure 13 which extends between a pair of upright end walls 14, the latter being rigidly joined together by a top wall 15 which extends generally parallel with the shelf structure 13. In the illustrated embodiment, the front of the shelf unit is closed by a door 16 which is typically hingedly mounted at its upper edge to the end panels or top wall so as to be swingable upwardly into an open position. The rear of the shelf unit 11 is normally open inasmuch as the rear side is closed by the wall panel 12 when the shelf unit is mounted thereon.

Figure 2:
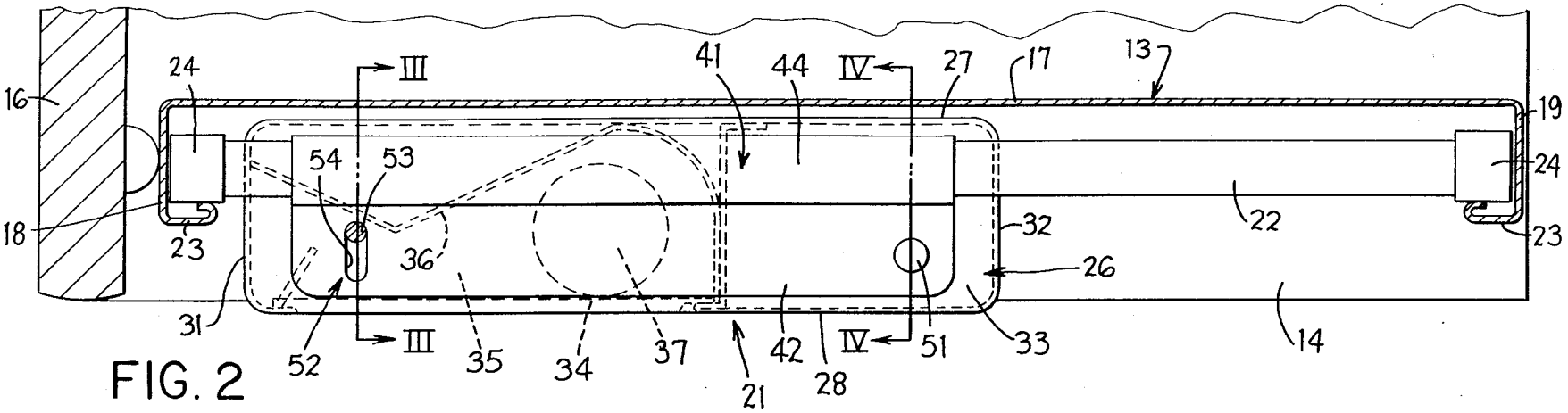
FIG. 2 is an enlarged fragmentary sectional view taken substantially along line II—II in FIG. 1 and illustrating a task light mounted under the bottom shelf of the shelf unit.

As illustrated by FIG. 2, the shelf structure 13 is normally defined by a shallow downwardly-opening channel member, the bight 17 of which defines a flat horizontally-extending shelf or support surface. This horizontal shelf or surface 17 has front and rear channels 18 and 19, respectively, which extend longitudinally along the edges thereof. These front and rear edge channels 18 and 19 project downwardly from the horizontal shelf 17, and the edge channels 18 and 19 themselves open inwardly toward one another.

A light fixture 21 is adapted to be supported below and partially positioned within the bottom channel member 13. For this purpose, a pair of horizontally elongated support bars 22 are releasably attached to the opposite ends of the light fixture, which support bars are disposed so as to be positioned within and extend transversely across the channel member 13 so that the opposite free ends of the support bars 22 hence project into the edge channels 18 and 19 and are thus supported on the lower legs 23 thereof. The free ends of the support bars 22 are preferably provided with an elastomeric or rubberlike cap 24 thereon so as to enable the support bars to remain stably in position. The bars 22, in this embodiment, are oriented in cross section in an upright or vertical position whereby the bars 22 engage the rail legs 23 solely at narrow contact areas defined by the narrow lower edge of the bar.

The light fixture 21 generally includes a boxlike housing 26 formed by generally parallel top and bottom walls 27 and 28 joined together by generally parallel front and rear walls 31 and 32. The housing is additionally closed by generally parallel end walls 33 which are rigidly joined to the aforementioned walls. The housing is typically constructed from thin metal plate, such as sheet metal. A part of the bottom wall 28 is removed to define a windowlike opening in which is positioned a conventional transparent or translucent diffuser 34, the latter being positioned directly below an interior light chamber 35. This latter chamber is defined between the diffuser 34 and a reflector 36, and a conventional light bulb (such as an elongated fluorescent tube) 37 is disposed within the light chamber.

The structure and operation of the light fixture 21, as briefly described above, is conventional.

To permit releasable and tiltable mounting of the light fixture 21 relative to the support bars 22, the fixture housing 26 has a pair of mounting brackets 41 provided on opposite ends thereof, which brackets are identical except for being mirror images of one another.

Figure 3:
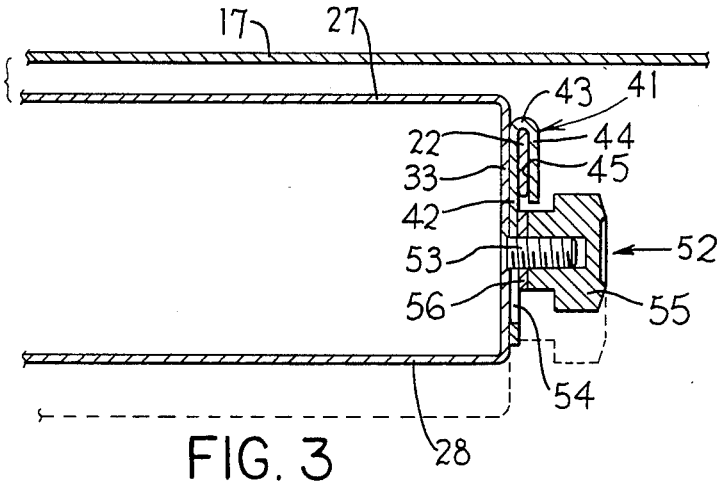
FIGS. 3 and 4 are fragmentary sectional views taken respectively along lines III—III and IV—IV in FIG. 2.
Figure 4:
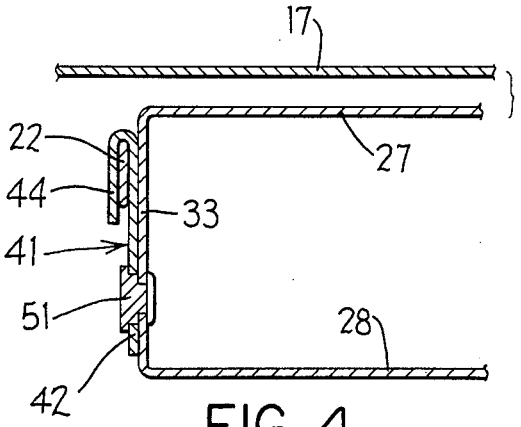

The mounting bracket 41 is disposed directly adjacent the respective housing end wall 33 and is elongated so as to extend generally in the front-to-back direction of the light fixture. This mounting bracket 41 includes a main platelike part 42 which substantially vertically and directly overlies the end wall 33 and, at its upper end, this platelike part 42 is provided with a reverse bend 43 (FIG. 3) which extends through approximately 180° so as to define a mount or hook part 44 which is directed downwardly in generally parallel relationship with the main part 42. These parts 42 and 44 are hence separated by a narrow downwardly-opening slot 45. This slot 45 has a width which only slightly exceeds the width of the support bar 22 so as to snugly receive the latter therein, and hence enable the mounting bracket 41 to hence be hooked over and thus supported on the support bar 22. The slot 45 opens longitudinally (that is, lengthwise) through the bracket.

The mounting bracket 41 is secured to the adjacent end wall 33 of the fixture housing by a releasable tilt structure which permanently but pivotally attaches the mounting bracket 41 to the end wall 33. This releasable tilt structure includes a pivot 51 which permanently joins the main part 42 and the end wall 33 but enables the bracket to be vertically displaced or tilted relative to the end wall substantially about the horizontal tilt axis defined by the pivot 51. This pivot 51 is preferably disposed adjacent one end of the bracket, preferably in the vicinity of the rear wall of the fixture housing.

The releasable tilt structure also includes a releasable lock 52 which coacts between the main bracket part 42 and the end wall 33 in the vicinity of the front wall of the fixture housing. This releasable lock 52 includes a pin or stud 53 which is fixed to the end wall 33 and projects perpendicularly outwardly therefrom through a substantially vertically elongated slot 54, which slot is preferably closed at opposite ends. The pin or stud 53 is externally threaded, and a knob 55 is rotatably threadably engaged on the exposed outer end of the pin 53. This knob, which is suitably sized so as to permit convenient manual gripping and rotation thereof, has an axial hub which is adapted to abut against a spacer washer 56, the latter being positioned in surrounding relationship to the pin 53 and axially interposed between the knob 55 and the bracket part 42.

By manually rotatably tightening the knob 55, the bracket part 42 is hence functionally locked into position between the knob and the end wall 33. By rotatably loosening the knob 55, the light fixture 21 can be tilted relative to the bracket about the pivot 51 as permitted by the extent of the slot 54, thereby permitting angular adjustment and hence selective limited tilting of the light fixture relative to the support bars 22, after which the knob 55 is again tightened to lock the fixture in the selected tilted position.

Figure 5:
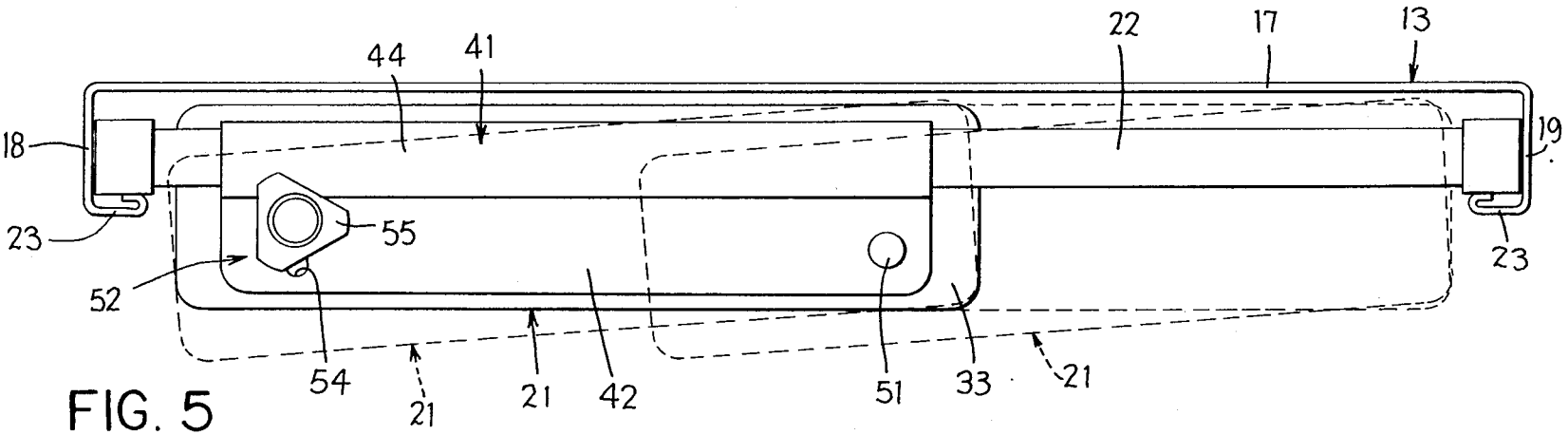
FIG. 5 is a view similar to FIG. 2 but illustrating, by dotted lines, alternate positions of the light, such as an angularly tilted position and a rearwardly-located position.

As indicated by solid lines in FIG. 5, the light fixture 21 is maintained substantially horizontally when in its uppermost position, that is the position wherein the threaded pin 53 is disposed at the upper end of the slot 54. However, the light fixture can be tilted downwardly about pivot 51 into the position indicated by dotted lines, this downward tilt being limited by the engagement of the threaded pin 53 with the bottom of the slot 54. This downward tilted position, which tilt is normally limited to a maximum of about 3° to about 5°, hence results in the diffuser 34 being inclined upwardly and rearwardly at a slight angle (namely the angle of tilt) and hence prevents the light energy emitted from the light fixture from being oriented directly into a person's eyes when the person is sitting down so that his/her eyes are at an elevation below the light fixture and directed generally toward the light fixture.

The person can hence readily adjust the tilt of a light fixture by selectively manually loosening the knobs 55 associated with the opposite end brackets 41, and then manually tilting the light fixture to the desired angle, and thereafter manually tightening the locking knobs 55 to maintain the fixture in the selected position.

The fixture can additionally be slidably moved either frontwardly or rearwardly along the support bars 22, substantially as also indicated by the multiple dotted line positions in FIG. 5, so as to permit the light fixture to be disposed in an optimum position under the shelf structure 13.

To initially install the light fixture under the shelves, the light fixture is first mounted on the bars 22, which bars are then disposed so that one ends thereof slip into one of the edge channels, following which the exposed portions of the bars (that is the portions outwardly from the mounting brackets) can be sufficiently resiliently flexed sidewardly as to enable the other bar ends to be deflected inwardly, raised upwardly into alignment with the other edge channel, and then resiliently deflected backwardly so as to project into the edge channel.

MODIFICATION

Referring now to FIGS. 6–10, there is illustrated a preferred variation of the invention. Corresponding parts illustrated by FIGS. 6–10 utilize the same reference numerals used in FIGS. 2–5 except for the addition of a prime (') thereto.

In this variation, the light fixture 21 has identical mounting brackets 41' secured to the opposite end walls 33. The bracket 41' has a small hole or opening 59' adjacent one end thereof, and a pivot 51' extends therethrough for attachment to the adjacent end wall 33 so as to define a substantially horizontal tilt axis, which axis is preferably disposed in the vicinity of the rear wall of the light fixture. The releasable tilt structure includes a releasable lock 52' which coacts between the main bracket wall 42' and the adjacent end wall 33 in the vicinity of the front wall of the fixture housing. This releasable lock 52' includes a pin or stud 53' which is fixed to the end wall 33 and project perpendicularly outwardly therefrom through a substantially vertically elongated slot 54', the latter preferably being closed at opposite ends. Pin 53' is externally threaded and has a knob 55' engaged thereon. Knob 55' can be manually gripped and rotated so as to loosen it from frictional abutting engagement with the bracket plate 42', whereupon the light fixture 21 can be angularly tilted about the pivot pin 51' relative to the bracket 41'. Rotatable tightening of the knob 55' causes it to frictionally engage the bracket wall 42', and hence results in the light fixture end wall 33 and bracket wall 42' being locked together in the selected tilt position of the light fixture.

The bracket wall 42' has a further opening 59'' formed therethrough adjacent the front corner thereof in close proximity to the slot 54', and a further slot 54'' is also formed through the bracket wall 42' closely adjacent the rear opening 59'. Identical combinations of slots and holes are formed adjacent opposite lower corners of the bracket wall 42' in mirror relationship, whereby the same bracket 41' can be utilized for mounting on either end of the light fixture housing.

The bracket 41' is provided with a mount 44' which projects outwardly from the bracket wall 42' so as to permit attachment or securement of the support rod 22'. This mount 44' includes a pair of generally parallel flanges 61 and 62 which project generally perpendicularly outwardly from the bracket wall 42'. These flanges 61 and 62 extend horizontally along the bracket in the front-to-rear direction over a substantial extent thereof. The flanges 61 and 62 define a narrow slot 63 therebetween, the latter being horizontally elongated in the front-to-back direction. Slot 63 opens horizontally outwardly in a direction away from the adjacent end wall 33 of the light fixture. The flanges 61 and 62 are, in the illustrated embodiment, segmented in the elongated direction thereof in that each flange includes shorter front and rear segments spaced from and on opposite sides of an elongate middle segment.

In the spaces between the segments of the flanges 61 and 62, the bracket 41' also provides a pair of locking clips 64, the latter being disposed adjacent opposite ends of the elongate middle flange segments 61 and 62. These clips 64 project outwardly from the bracket wall 42', and define thereon lower surfaces 66 which are substantially aligned with the upper boundary of the slot 63, this upper boundary being defined by the lower surface of the upper flange 61. Locking clips 64 adjacent their free ends are provided with downwardly projecting hook parts 67. The locking clips 64, due to their cantilevered projection from the bracket wall 42', can resiliently deflect upwardly, such as by being cammed upwardly by slidable engagement of the support bar 22' with the lower tapered nose on the hook part 67 so that the support bar 22' can be fully inserted into the slot 63.

The bracket 41' also includes several reinforcing ribs 68 which extend transversely away from the appropriate flanges 61 and 62.

In this preferred variation of FIGS. 6–9, the support bars 22' are no longer oriented in an upright condition, but rather are oriented in a flat or horizontal condition. That is, the thin platelike bar 22' is oriented so that its width is substantially horizontal, and the plastic caps 24' provided on the ends of the bars 22' now have a substantially wide contact area with the rails 23 to provide for uniform support, particularly when transverse sliding of the light fixture beneath the shelf is desired.

Figure 7:
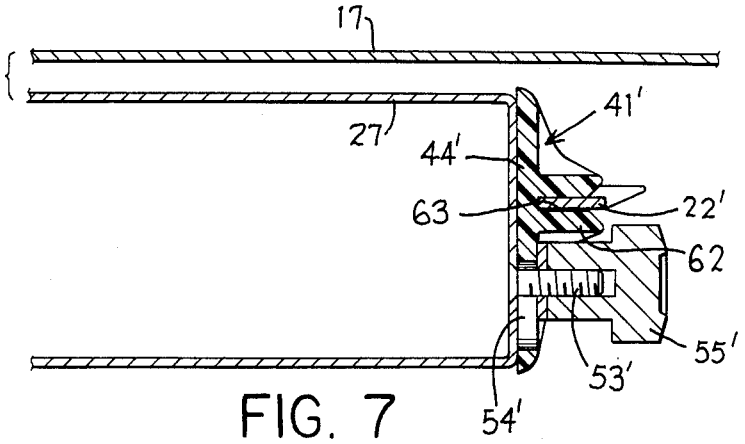
FIGS. 7 and 8 are fragmentary sectional views taken substantially along lines VII—VII and VIII—VIII, respectively, in FIG. 6.
Figure 8:
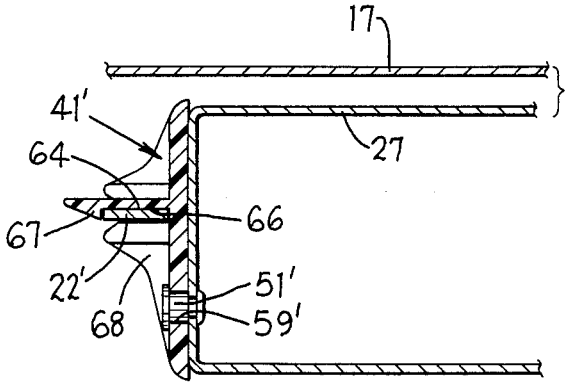
Figure 10:
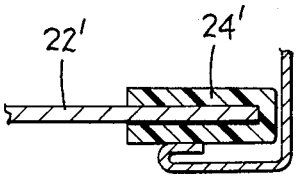
FIG. 10 is a fragmentary sectional view taken along line X—X in FIG. 9.

With this variation, the supports bars 22' engage the respective brackets 41' by being sidewardly slidably inserted into the slots 63, substantially as illustrated by FIG. 7. During this insertion, the locking clips 64 resiliently deflect upwardly so as to enable the support bar 22' to be slidably inserted into the slot 63. When the support bar 22' is fully into the slot 63, the hooks 67 resiliently snap downwardly so as to overlap the outer edge of the support bar 22' substantially as illustrated by FIG. 8. This positively locks the support bar 22' to the bracket 41'. This lock can be easily manually released, however, by deflecting the locking clips 64 upwardly, and then slidably withdrawing the support bar 22' from the slot 63.

This mounting variation also facilitates mounting of the light fixture into the cavity below the shelf 13. With this arrangement, the two support bars 22' can be initially positioned under the shelf so as to transversely extend between and be supported on the rails 23. Thereafter, the light fixture 21 can be moved upwardly beneath the shelf so as to be positioned between the bars 22'. The support bars 22' are then individually slidably moved inwardly into engagement with the respective mounting bracket 41'. This mounting relationship eliminates any need to perform various skewing movements of the light fixture and/or of the bars during mounting thereof beneath the shelf.

The bracket 41' is preferably formed in one piece, as by being molded of a plastic material.

Figure 6:
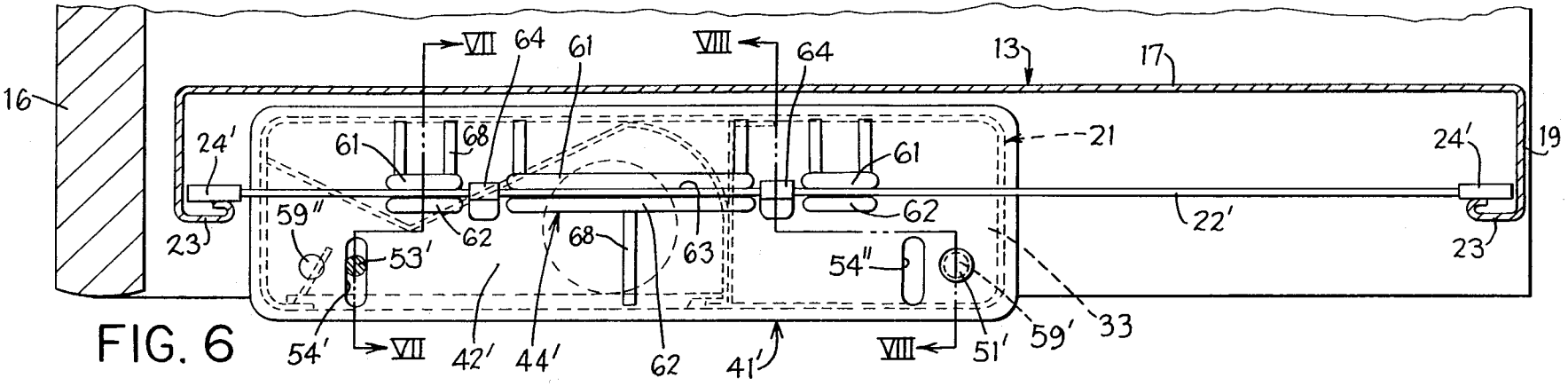
FIG. 6 is a view similar to FIG. 2 but illustrating a preferred variation of the invention.
Figure 9:
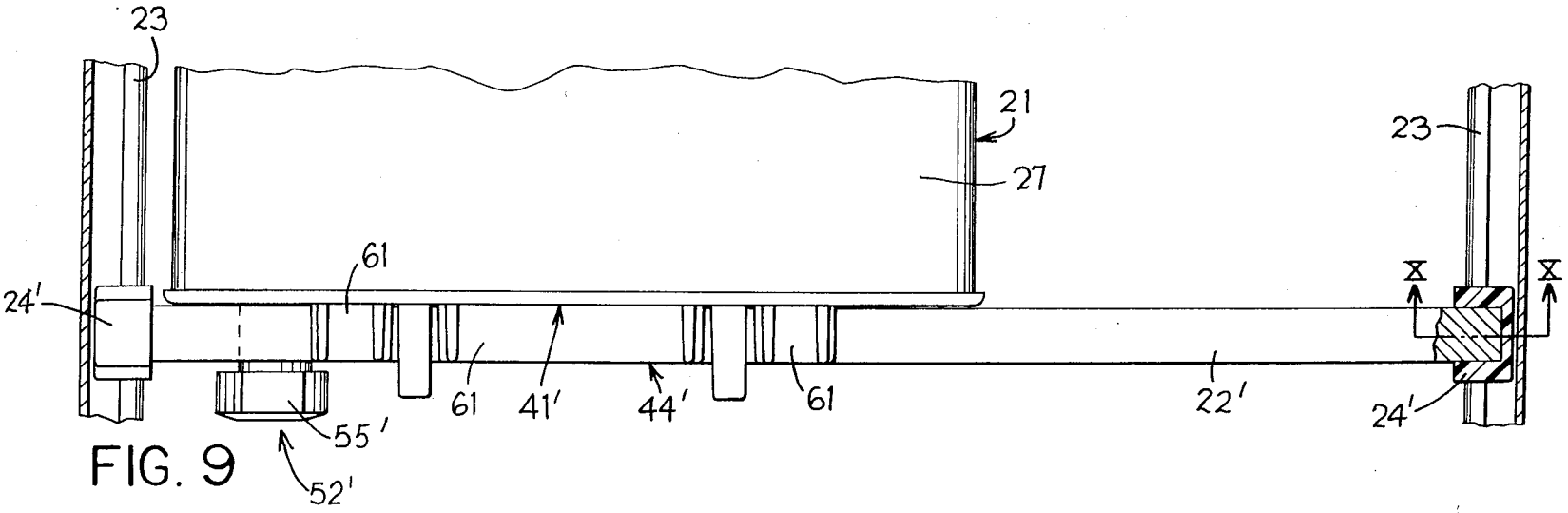
FIG. 9 is a fragmentary top view taken directly below the horizontal shelf of the cabinet.

As illustrated by FIG. 6, the slot 54' (or 54'') preferably extends a small extent upwardly above the horizontal plane passing through the centerlines of the holes 59' and 59''. In this manner, the pin 53' will be spaced downwardly a small distance from the upper end of the slot 54' when the light fixture is horizontal, substantially as illustrated by FIG. 6. This enables the light fixture to have the front edge thereof tilted slightly upwardly, such as about 2° above the horizontal if desired, and at the same time permits the front edge to be tilted downwardly from the horizontal to an angle in the range of about 4°.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In combination comprising: a shelf structure having a substantially planar and horizontally enlarged shelf, and front and rear channels which extend substantially horizontally and longitudinally along respective front and rear edges of said shelf and project downwardly therefrom, said front and rear edge channels being disposed so that they open toward one another in opposed relationship; and a light fixture positioned directly below said shelf between said front and rear edge channels, said light fixture including a boxlike housing having a pair of generally vertically extending end walls which are disposed substantially perpendicularly between said front and rear channels, said light fixture also having a light bulb stationarily mounted within said housing; the improvement comprising:

adjustable mounting means coacting between each said end wall and said shelf structure for permitting the position of the light fixture to be vertically angularly varied relative to the shelf structure;

said adjustable mounting means including a mounting bracket disposed adjacent each said end wall, said mounting bracket being longitudinally elongated in a front-to-back direction of the housing and pivotally joined to a respective said end wall for relative vertical pivoting therebetween about a substantially horizontal pivot axis;

said adjustable mounting means also including releasable and lockable adjusting means connecting said mounting bracket to a respective said end wall for selectively adjusting the vertical angularity of the bracket relative to the end wall to vary the vertical angularity of the light fixture with respect to the shelf, said adjusting means including (a) a pin-and-slot connection coacting between said bracket and said end wall in spaced relationship from said pivot axis for permitting relative vertical pivoting between said end wall and said bracket, and (b) a manually releasable locking element releasably cooperating between the mounting bracket and the end wall for permitting the bracket to be selectively locked to the end wall at a selected position as tilted about the pivot axis;

said adjustable mounting means further including an elongate support bar which is separable from said bracket and which is positioned beneath said shelf and extends transversely thereacross so that opposite ends of said elongate support bar project into and is supported on the opposed edge channels; and said bracket having slot means defined thereon for accommodating therein said support bar for permitting the bracket to be releasably supported on the support bar, said slot means extending longitudinally of the bracket in the front-to-back direction of the light fixutre.

2. The combination according to claim 1, wherein the pin-and-slot connection includes a stud which is fixed to the end wall and projects outwardly therefrom through an elongate slot like opening formed through said bracket, and said locking element comprising a lock knob movably engaged with said stud for locking the bracket and end wall together in the selected position.

3. The combination according to claim 2, wherein said bracket has resilient locking clip means mounted thereon for resiliently lockingly engaging said support bar when the support bar is disposed within said slot means.

4. The combination according to claim 1, wherein said bracket includes a generally planar base wall which exteriorly overlies said end wall, said pivot being located adjacent one end of said bracket and said pin-and-slot connection being located adjacent the other end of said bracket.

5. The combination according to claim 1, wherein said slot means defines a narrow slot which is open along one side thereof for permitting the support to be slidably moved transversely relative to the bracket into and out of the slot.

6. The combination according to claim 1, wherein the mounting brackets as disposed adjacent the end walls of the housing are identical but disposed in oppositely facing directions relative to one another, each said mounting bracket having a pair of pivot-defining holes formed therethrough adjacent opposite ends thereof and also having a pair of angularity-adjusting slots formed therethrough adjacent opposite ends thereof so that each said angularity-adjusting slot is disposed in close proximity to one of said pivot-defining holes, the pivot-defining hole adjacent one end of the mounting bracket having a pivot member associated therewith for pivotally joining the mounting bracket to the housing for defining said pivot axis, and the angularity-adjusting slot as disposed adjacent the other end of the mounting bracket being a part of the pin-and-slot connection, the combination of the pivot-defining hole and the adjacent angularity-adjusting slot as disposed adjacent one end of the mounting bracket being in mirror relationship to the combination of the pivot-defining hole and adjacent angularity-adjusting slot as disposed adjacent the other end of the mounting bracket so that identical mounting brackets can be utilized and disposed adjacent the opposite end walls of the light fixutre housing.

7. The combination according to claim 6, wherein each mounting bracket is molded in one piece of a plastics material and includes a substantially vetically enlarged plate like base wall which is disposed directly adjacent and substantially overlies the respectively adjacent end wall of the housing.

8. Improvements in a light fixture adapted for mounting on front and rear edge channels which are secured to and project downwardly below a horizontally enlarged shelf, said light fixture including a box-like housing having a pair of generally vertically extending end walls which are adapted to be disposed substantially perpendicularly between the front and rear channels, the light fixture also having a light bulb stationarily mounted within the housing, the improvement comprising:

adjustable mounting means coacting with each said end wall for permitting the position of the light fixutre to be vertically angularly varied;

said adjustable mounting means including a mounting bracket disposed adjacent each said end wall, said mounting bracket being longitudinally elongated in a front-to-back direction of the housing and pivotally joined to a respective said end wall for relative vertical pivoting therebetween about a substantially horizontal pivot axis;

said adjustable mounting means also including releasable and lockable adjusting means connecting said mounting bracket to a respective said end wall for selectively adjusting the vertical angularity of the bracket relative to the end wall to vary the vertical angularity of the light fixture, said adusting means including (a) a pin-and-slot connection coacting between said bracket and said end wall in spaced relationship from said pivot axis for permitting relative vertical pivoting between said end wall and said bracket, and (b) a manually releasable locking element releasably cooperating between the mounting bracket and the end wall for permitting the bracket to be selectively locked to the end wall at a selected position as tilted about the pivot axis;

said adjustable mounting means further including an elongate support bar which is separable from said bracket and which is adapted to be positioned beneath said shelf and extend transversely thereacross so that opposite ends of said elongate bar are adapted to be supported on opposed edge channels of the shelf; and said bracket having slot means defined thereon for accommodating therein said support bar for permitting the bracket to be releasably supported on the support bar, said slot means extending longitudinally of the bracket in the front-to-back direction of the light fixture.

9. A light fixture according to claim 8, wherein the mounting brackets as disposed adjacent the end walls of the housing are identical but disposed in oppositely facing directions relative to one another, each said mounting bracket having a pair of pivot-defining holes formed therethrough adjacent opposite ends thereof and also having a pair of angularity-adjusting slots formed therethrough adjacent opposite ends thereof so that each said angularity-adjusting slot is disposed in close proximity to one of said pivot-defining holes, the pivot-defining hole adjacent one end of the mounting bracket having a pivot member associated therewith for pivotally joining the mounting bracket to the housing for defining said pivot axis, and the angularity-adjusting slot as disposed adjacent the other end of the mounting bracket being a part of the pin-and-slot connection, the combination of the pivot-defining hole and the adjacent angularity-adjusting slot as disposed adjacent one end of the mounting bracket being in mirror relationship to the combination of the pivot-defining hole and adjacent angularity-adjusting slot as disposed adjacent the other end of the mounting bracket so that identical mounting brackets can be utilized and disposed adjacent the opposite end walls of the light fixture housing.

10. The combination according to claim 5, wherein said narrow slot opens generally horizontally of the bracket in a direction which extends substantially perpendicularly outwardly away from the adjacent end wall of the light fixture, said support bar being a vertically thin platelike element in cross section and movable horizontally sidewardly in generally perpendicular relationship toward the end wall so as to be slidably moved into said narrow slot.

11. The combination according to claim 10, wherein said bracket includes a generally planar base wall which overlies said end wall and a pair of generally parallel and vertically spaced flanges which project perpendicularly outwardly from said base wall in a direction away from said end wall, said flanges defining said narrow slot therebetween.

12. The combination according to claim 11, wherein said bracket has resilient locking clip means projecting in a cantilever fashion outwardly away from said base wall so as to resiliently lockingly engage said support bar to releasably hold it within said narrow slot.

13. The combination according to claim 12, wherein the bracket is integrally molded in one piece of a plastic material.

14. The combination of claim 11, wherein the bracket includes a base wall which is generally parallel with and overlies the respectively adjacent end wall of the light fixture, the bracket also having a hook structure which projects outwardly from the base wall in a direction away from the end wall and which opens downwardly to define said narrow slot so that said support bar can be relatively vertically slidably moved upwardly relative to the bracket for engagement within said slot.

* * * * *